US007959372B2

(12) United States Patent
Shanley

(10) Patent No.: US 7,959,372 B2
(45) Date of Patent: Jun. 14, 2011

(54) MOLDED SECTIONAL CURB CONSTRUCTIONS IN COMBINATION WITH PAVED ROADWAYS AND METHOD

(76) Inventor: Patrick T. Shanley, Houghton Lake, MI (US)

( * ) Notice: Subject to any disclaimer, the term of this patent is extended or adjusted under 35 U.S.C. 154(b) by 53 days.

(21) Appl. No.: 12/592,279

(22) Filed: Nov. 20, 2009

(65) Prior Publication Data

US 2010/0143032 A1 Jun. 10, 2010

Related U.S. Application Data

(62) Division of application No. 12/150,892, filed on Apr. 30, 2008.

(51) Int. Cl.
*E01C 11/22* (2006.01)

(52) U.S. Cl. ..... 404/2; 404/32

(58) Field of Classification Search ..... 404/2, 4, 404/17, 32

See application file for complete search history.

(56) References Cited

U.S. PATENT DOCUMENTS

| | | | | |
|---|---|---|---|---|
| 459,754 | A | 9/1891 | King | |
| 510,016 | A | 12/1893 | Gaffney | |
| 691,794 | A | 1/1902 | Morss | |
| 739,854 | A | 9/1903 | Gest | |
| 775,791 | A | 11/1904 | Austin | |
| 4,387,882 | A | 6/1983 | Mansour et al. | |
| 5,282,691 | A * | 2/1994 | McIntosh et al. | 404/3 |
| 5,693,413 | A | 12/1997 | Hesterman et al. | |
| 5,879,106 | A | 3/1999 | Beamer | |
| 6,767,160 | B2 * | 7/2004 | Sansalone | 404/17 |
| 7,351,004 | B2 * | 4/2008 | Shaw et al. | 404/17 |
| 7,425,105 | B2 * | 9/2008 | Grimes | 404/2 |
| 7,455,473 | B1 | 11/2008 | Lee et al. | |
| 7,575,394 | B2 * | 8/2009 | Shaw et al. | 404/72 |
| 7,699,557 | B2 * | 4/2010 | Shaw et al. | 404/2 |
| 2006/0222458 | A1 | 10/2006 | Grimes | |
| 2008/0292396 | A1 * | 11/2008 | Shanley | 404/2 |
| 2008/0304908 | A1 * | 12/2008 | Ko | 404/2 |

FOREIGN PATENT DOCUMENTS

| | | | |
|---|---|---|---|
| DE | 3541644 | A1 | 11/1985 |
| EP | 0344423 | A1 | 3/1989 |

* cited by examiner

*Primary Examiner* — Gary S Hartmann
(74) *Attorney, Agent, or Firm* — John R. Benefiel

(57) ABSTRACT

A gutter curb for paved roadways is constructed of an assembled series of elongated sections of gutter curbs connected together end to end, which are assembled along at least one side of a road bed. The gutter curb sections are molded from rubber from recycled tires and are held to the adjacent roadway pavement by tie rods passing through opposite sides gutter curb sections and projecting into the pavement itself to be securely held thereto.

9 Claims, 2 Drawing Sheets

MOLDED SECTIONAL CURB CONSTRUCTIONS IN COMBINATION WITH PAVED ROADWAYS AND METHOD

CROSS REFERENCE TO RELATED APPLICATIONS

This application is a divisional of U.S. Ser. No. 12/150,892 filed May 1, 2008 which claims the benefit of U.S. provisional application no. 60/915,194 filed on May 1, 2007.

BACKGROUND OF THE INVENTION

This invention concerns paved roadways, and in particular curbs and gutters for roadways. Conventional practice has been to cast curbs and gutters in concrete at the site. Such practice has been implemented using complex equipment which is too expensive for small municipalities and are subject to state inspection and specifications which are difficult to meet. Manual methods are slow due to the need for hand finishing.

Concrete curbs must be removed at driveways, etc., which is difficult and expensive.

Concrete curbs also present hazardous obstacles which can damage road plows and vehicle tires when impacted.

It has heretofore been proposed to mold rubber from recycled tires into bumper strips and curbing installed onto existing roadways and for landscape applications, but these have been add on installations which do not replace the gutter-curb portions of conventional concrete curbs of paved roadways It is an object of the present invention to provide an improved construction of roadway curbs and gutters which can be installed at low cost and easily removed in sections as for making repairs and for providing curb openings for driveways.

It is another object to reduce the hazard of curbs as obstacles which damage road clearing equipment and vehicle tires.

SUMMARY OF THE INVENTION

These and other objects which will become apparent upon a reading of the following specification and claims are achieved by molded rubber elongated curb-gutter sections which are configured to constitute the gutter-curb portions of conventional roadways and to be integrated therewith. The sections are assembled to each other end to end to form a continuous gutter curb and which are anchored to the roadway itself by the tie rods extending completely through the gutter curb sections and projecting into the paving material to key the molded curb gutter sections to the pavement. The tie rods are threaded to enable easy removal of any gutter curb section from the pavement by removing nuts on the rods at the outside of the gutter curb section.

The gutter-curb sections are molded from ground up used tire rubber material bonded together using a urethane binder in a manner well known in the art. This allows penetration through the gutter-curb of water vapor to improve weatherability. The sections are light enough to be handled manually during installation. The material reduces the problems of curb impacts damaging equipment or vehicle tires while still being durable enough for practical use as a component of paved roadways.

A mountable embodiment profit is also provided with a shallowly inclined curb wall which is low enough to allow driving over to eliminate the need for cutting driveway openings into the gutter curb sections.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
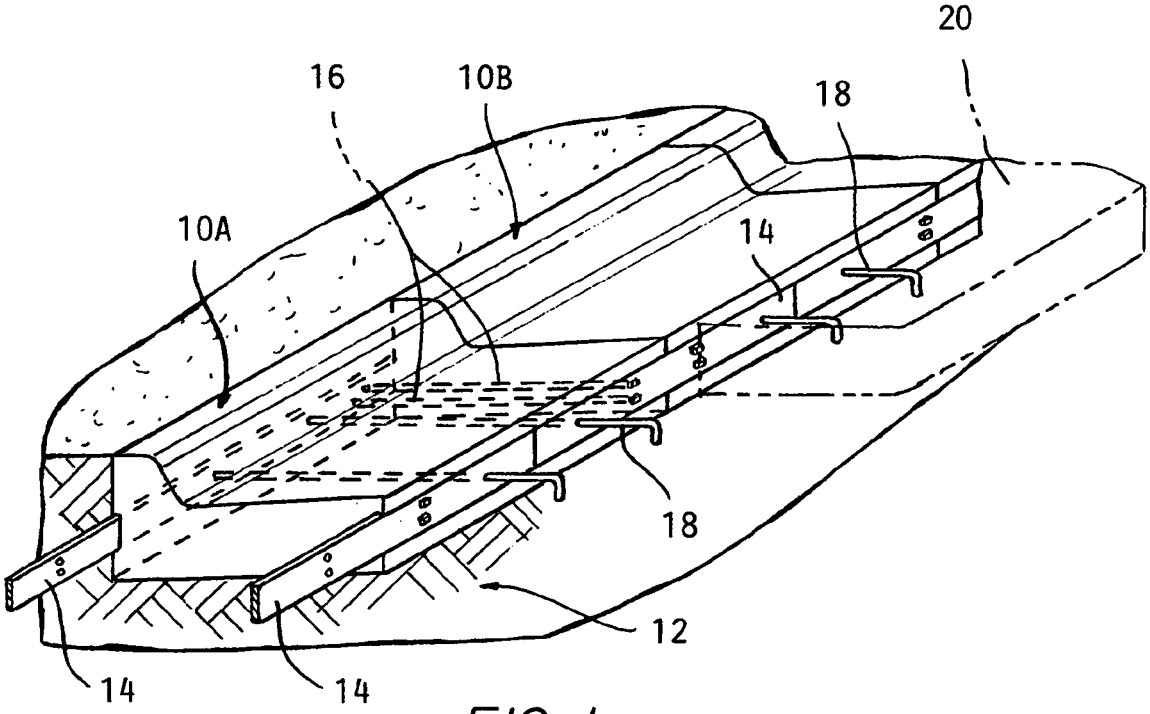
FIG. 1 is a pictorial fragmentary view of a section of a roadway with two gutter-curb sections according to the invention installed adjacent the roadway paving on a prepared roadway bed.
Figure 2:
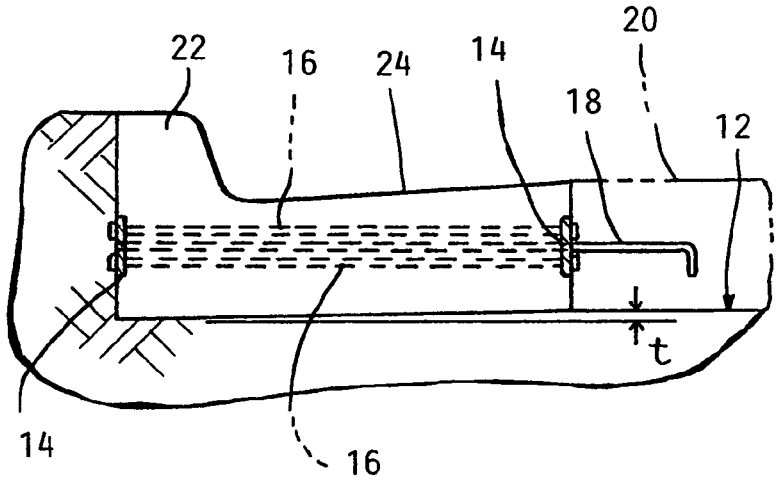
FIG. 2 is a sectional view taken across a gutter-curb section and showing adjacent roadway paving.

Referring to FIG. 1, a roadway segment is shown comprised two end to end abutting gutter curb sections 10A, 10B resting in a prepared roadway bed 12. The gutter-curb sections 10A, 10B (preferably on the order of three feed long) comprise elongated bodies, which are connected together end to end with ½ inch elongated steel plates 14 predrilled with holes aligned with through holes extending between the opposite sides of each section 10A, 10B. Both ends of the tie rods 16 and on end of the tire rods to receive pairs of epoxy coated threaded rods 16 and tie rods 18 threaded at a backend, have nuts and lock washers installed thereon. The tie rods 18 project from the front face of the gutter-curb sections 10A, 10B a substantial distance, i.e., 8 inches more or less to be securely joined to the paving 20, typically either reinforced concrete or asphalt.

The gutter-curb sections 10A, 10B are preferably molded from an elastomeric such as rubber comprised of particles of ground up recycled used tires bound together with a urethane binder. Such molded material is well known in the art and has been used for sidewalks, etc.

Preferably a smoother surface layer comprised of fine particles, i.e. 30 mesh, is deposited over a more porous inner region using coarser (14 mesh) particles at the time the gutter curb sections are being molded.

Each gutter curb section 10A, 10B has a slightly inclined bottom surface with a raised shoulder 22 at an opposite side from a downwardly inclined sloping surface 24 extending from a front side, thereby forming a gutter depression able to collect water and direct it to drains (not shown) typically provided along a roadway for handling rain water runoff.

Figure 3:
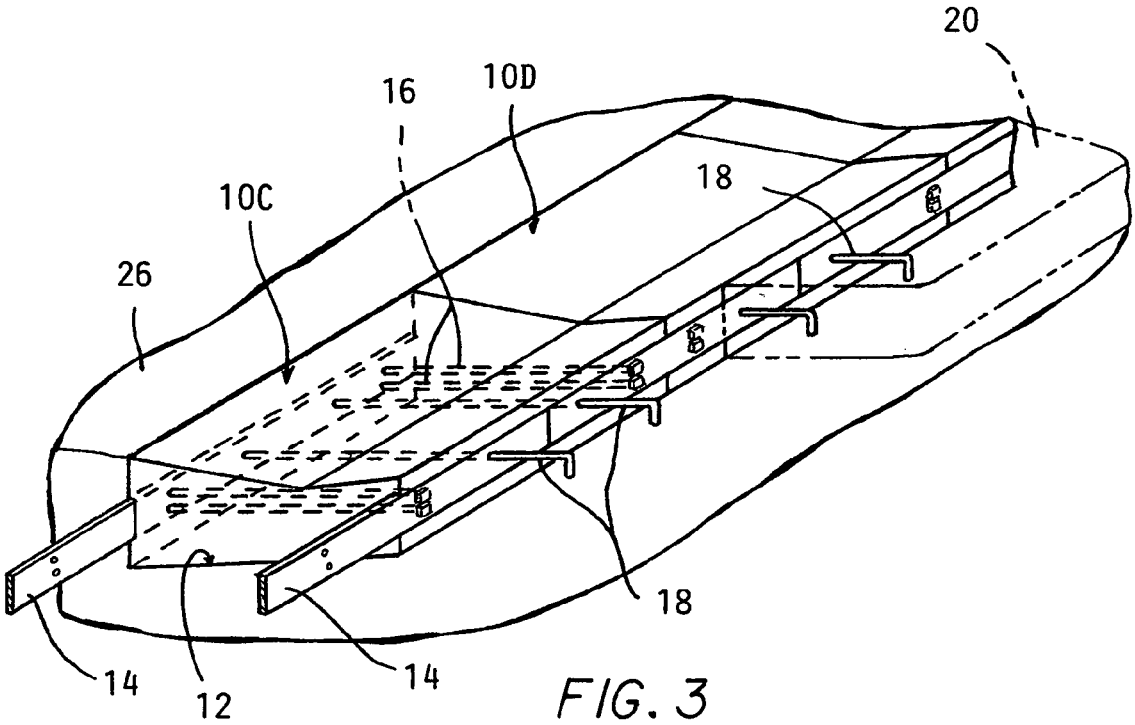
FIG. 3 is a pictorial view of a second embodiment of a gutter curb installed adjacent to roadway paving on a roadway bed.
Figure 4:
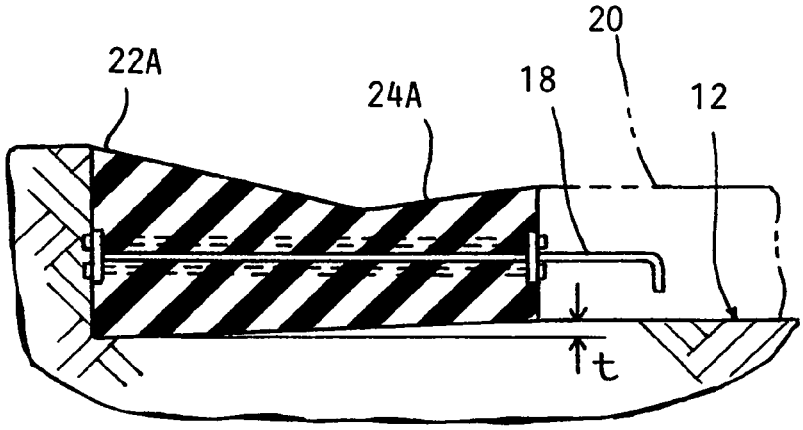
FIG. 4 is a cross sectional view of a gutter-curb section shown in FIG. 3.

FIGS. 3 and 4 show a second embodiment of the gutter-curb sections 10C, 10D which are of a profile designed to allow driving over the same as where a driveway 26 intersects the roadway 20. This eliminates the need for removing or cutting away the gutter-curbs 10 at driveways.

In this embodiment instead of a pronounced shoulder, a shallowly inclined surface 22A intersects a shortened street side shallowly inclined surface 24A which is shorter than the corresponding inclined surface 24 in the first described embodiment. The surface 22A creates a very gentle shoulder on the side of the sections 10C, 10D away from the roadway 20.

A shallow vee shaped gutter is created in the upper surface of the sections 10C, 10D thereby while eliminating the steeper shoulder 22 of the first described embodiment so as to render the gutter-curb 10C, 10D easily "mounted" or driven over. Thus, removal of the shoulder 22 at driveways is not necessary.

There are a number of advantages of using this gutter-curb in roadway construction, including:

The freeze/thaw advantage of rubber over concrete is that rubber will move with surface aggregates even in most extreme conditions.

Easy installation is afforded as no on site forming is needed, thus saving time and labor on a project. Premanufactured parts reduce amount of skilled labor and time needed to complete a project.

Cure time of concrete can vary according to weather, temperature, and multiple other conditions. Premanufactured rubber gutter-curbs are unaffected by these on site conditions.

Northern climate areas can have longer road working season because rain and snow conditions will not affect rubber gutter curb parts, whereas concrete work must be stopped in those conditions.

Because of the makeup of the materials and density of the rubber gutter curb, flash flooding in low areas or dips in roadway will be significantly reduced because rubber gutter curbs will allow drainage through them rather than trapping the water and creating dangerous puddles that can cause drivers to lose control.

The life expectancy of a rubber gutter-curbs will be significantly longer than concrete, as rubber tires can last up to as long as 100 years.

Rubber gutter curbs also have a great safety advantage over concrete, as they are less likely to hurt pedestrians in a fall.

Rubber gutter curbs also have the option of being colored with a wide range of colors, be it for safety, decorative reasons, or reflective markings for night locating.

Rubber gutter curb systems can easily adapt to existing storm water systems.

A mountable gutter curb used in roadways are also a great advantage to residential developers because no curb cuts are necessary after road is completed.

The rubber gutter curbs are preferably made of 100% recycled tires and water based urethane binders. They use very little energy to manufacture and help clean up what is a serious environmental problem, i.e., discarded tires.

The rubber gutter curb can be dismantled, relocated and reused easily again. Sections 36 inches long allow new openings to be made or repairs to the curbing with minimal interruption to existing curbing.

The invention claimed is:

1. A paved roadway comprising:

a compacted road bed;

a gutter curb along at least one side of said road bed, each gutter curb comprising a series of gutter curb sections each section comprising an elongated body of ground up recycled tire material molder together with a binder so as to be water permeable, said gutter curb sections connected together end to end, each of said gutter curb sections having an upper surface formed into a gutter;

said gutter body sections each mounting tie rods having one end projecting therefrom a substantial distance over said road bed; and pavement overlying said road bed and extending up to said gutter curb and encasing said projecting tie rod one ends therein to secure said curb sections to said pavement.

2. The roadway of claim 1 wherein said tie rods are threaded and secured at an opposite end protruding from an opposite side with a nut threaded thereon to thereby be removable from said pavement by removing said nuts and pulling said gutter curb sections from said tie rods each having said one end encased in said pavement.

3. The roadway of claim 2 wherein adjacent sections of gutter curbs are connected by splice plates extending along said opposite sides of abutting gutter curb sections.

4. The roadway according to claim 1 whereon each of said curb sections have a base side adapted to rest on said road bed, upwardly extending opposite sides, and an upper surface defined by a downwardly inclined shallow surface extended from a front side towards the other side, and a shoulder extending upwardly from said other side together forming a gutter in said upper surface.

5. The roadway according to claim 4 wherein a series of through holes are formed extending from one side to the other of said curb bodies receiving rods installed therein having ends protruding from either side with fasteners securing said rods therein.

6. The roadway according to claim 4 wherein said gutter curbs are connected together end to end by splice plates extending along said opposite sides and onto opposite sides of a next adjacent gutter curb, held against said sides with said rods passing through said holes therein.

7. The roadway according to claim 4 wherein said upwardly inclined shoulder is defined by a shallowly inclined surface which terminates at said opposite side to be drivable thereover with minimal shock.

8. The roadway according to claim 1 wherein said top front surfaces of said gutter curbs are substantially flush with said roadway pavement.

9. The roadway according to claim 1 wherein said binder is water based urethane.

* * * * *